US005542852A

United States Patent [19]

Hsueh

[11] Patent Number: 5,542,852

[45] Date of Patent: Aug. 6, 1996

[54] SAFETY PROTECTION AC MAINS POWER SOCKET

[76] Inventor: Yu-Yuan Hsueh, 3rd Floor, No. 6, Lane 60, Ton Sen Road, Hsinchu, Taiwan

[21] Appl. No.: 282,472

[22] Filed: Jul. 29, 1994

[51] Int. Cl.[6] ..... H01R 13/44

[52] U.S. Cl. ..... 439/135; 174/67

[58] Field of Search ..... 439/135, 651, 439/652, 653, 654, 136, 142, 148, 682, 686, 690, 691, 915, 281, 282; 174/67

[56] References Cited

U.S. PATENT DOCUMENTS

| | | | |
|---|---|---|---|
| 1,568,156 | 1/1926 | Herskovitz | 439/652 |
| 3,140,344 | 7/1964 | Slater et al. | 439/142 |
| 4,250,349 | 2/1981 | Bennett | 439/142 |
| 5,098,310 | 3/1992 | Avramovich et al. | 439/282 |

*Primary Examiner*—Neil Abrams
*Assistant Examiner*—Barry Matthew L. Standig
*Attorney, Agent, or Firm*—Morton J. Rosenberg; David I. Klein

[57] ABSTRACT

The invention herein relates to a kind of safety protection AC mains power socket that mainly consists an additional AC mains power socket in a recessed section at the rear end of an AC mains power plug which provides a kind of AC mains power plug that accommodates the insertion of a second AC mains power plug while the invention herein is plugged into a wall-type AC mains power socket. Furthermore, invention herein has a cover plate for the recessed section that effectively enhances safe usage by preventing the entry of objects and dust when the additional AC mains power socket of the invention herein is not being utilized.

3 Claims, 7 Drawing Sheets

SAFETY PROTECTION AC MAINS POWER SOCKET

BACKGROUND OF THE INVENTION

A conventional rapid insertion-type AC mains power plug is depicted in FIG. 1, wherein there are prongs (11) at the front end and a pair of insertion holes at the rear end (12) that provides for the insertion of another AC mains power plug (2) to permit the extension of the electrical current source. However, since the rear end (12) of the aforesaid conventional AC mains power plug is comprised of a fiat surface, when another AC mains power plug (2) is inserted, the AC mains power plug (2) is easily dislodged by the impact of an external force during usage such that angle of insertion is no longer perpendicular or even result in complete removal due to impractical structure of the aforementioned conventional AC mains power plug.

The primary objective of the invention herein is to overcome the disadvantages of conventional AC mains power plug products and to provide a stable safe design, the innovations and effectiveness of which are elaborated in the attached drawings and derailed description of the invention herein.

DESCRIPTION OF THE PREFERRED EMBODIMENTS

Figure 1:
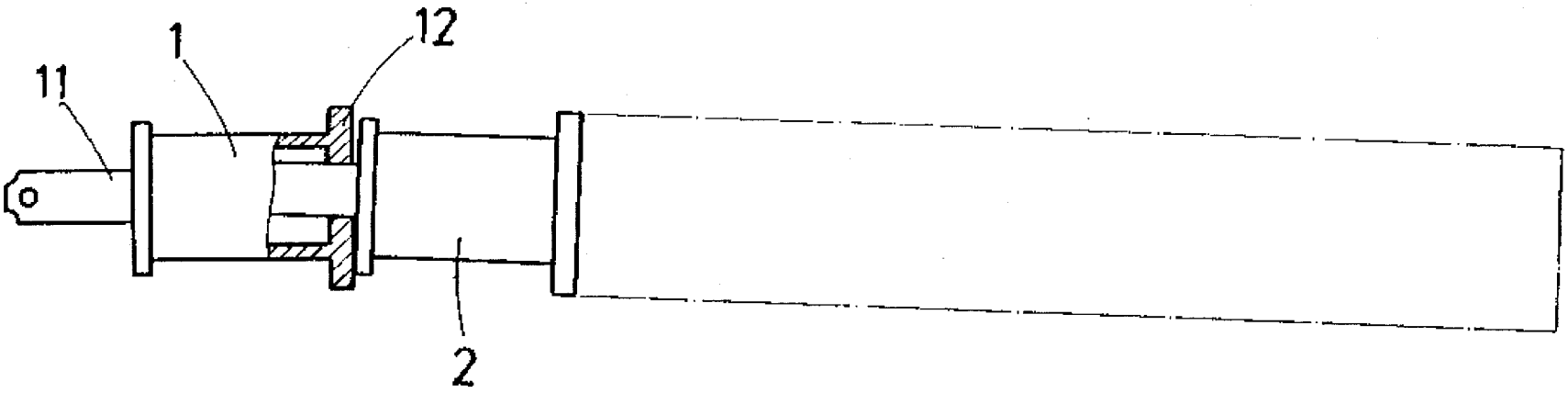
FIG.1 (PRIOR ART)
FIG. 1 is an orthographic drawing of a conventional AC mains power plug.
Figure 2:
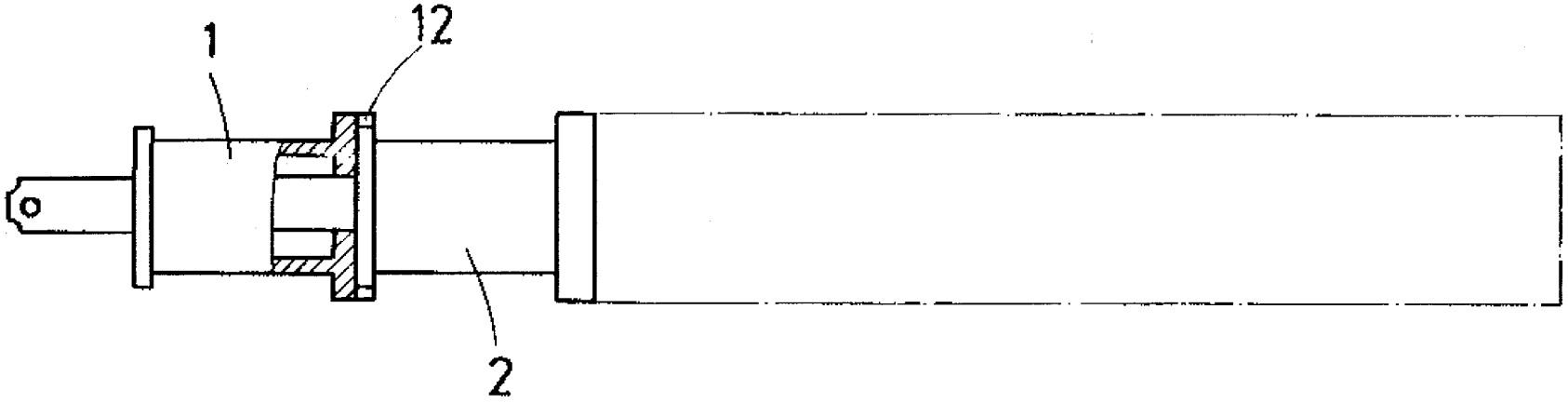
FIG. 2 is an orthographic drawing of the AC mains power plug of the invention herein.
Figure 3:
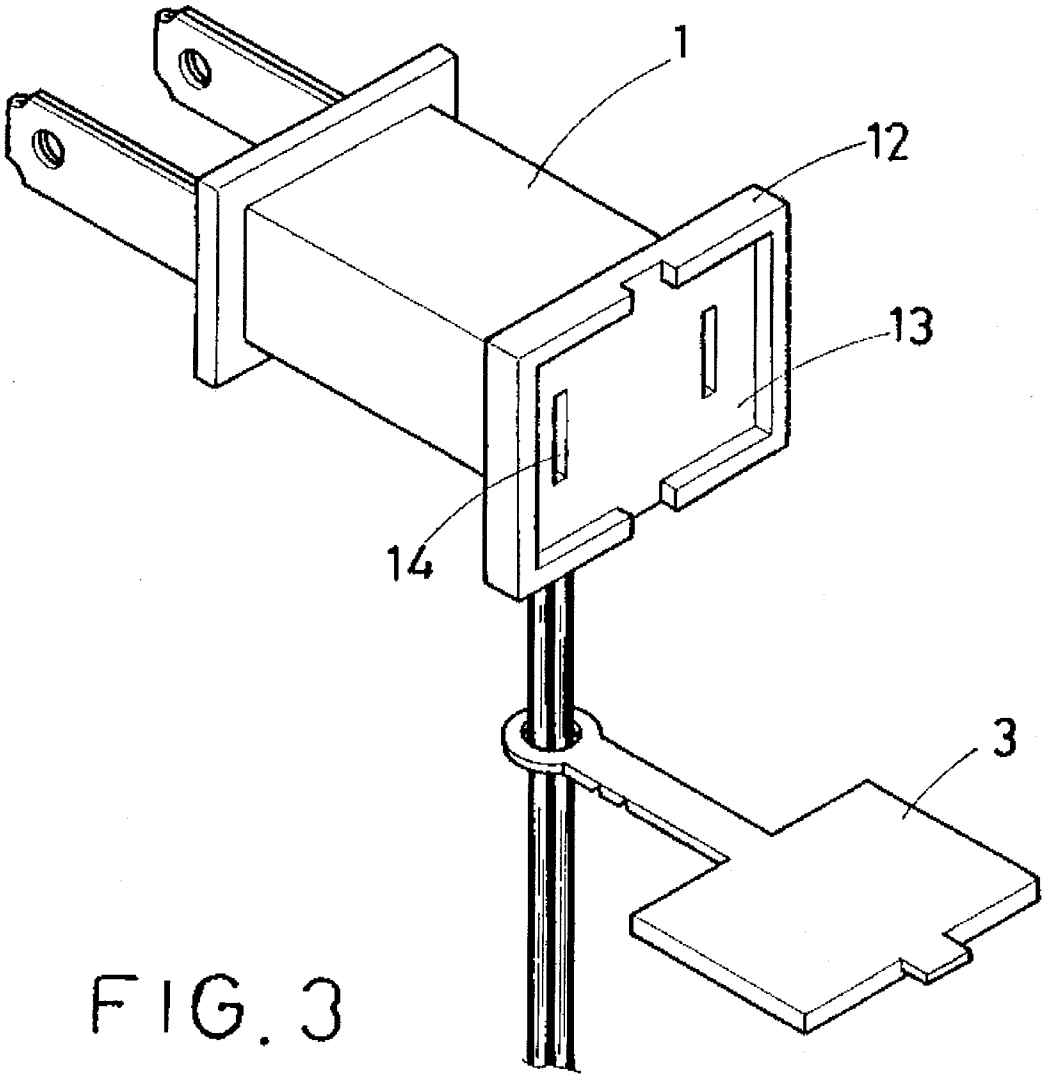
FIG. 3 is an isometric drawing of the invention herein.
Figure 4:
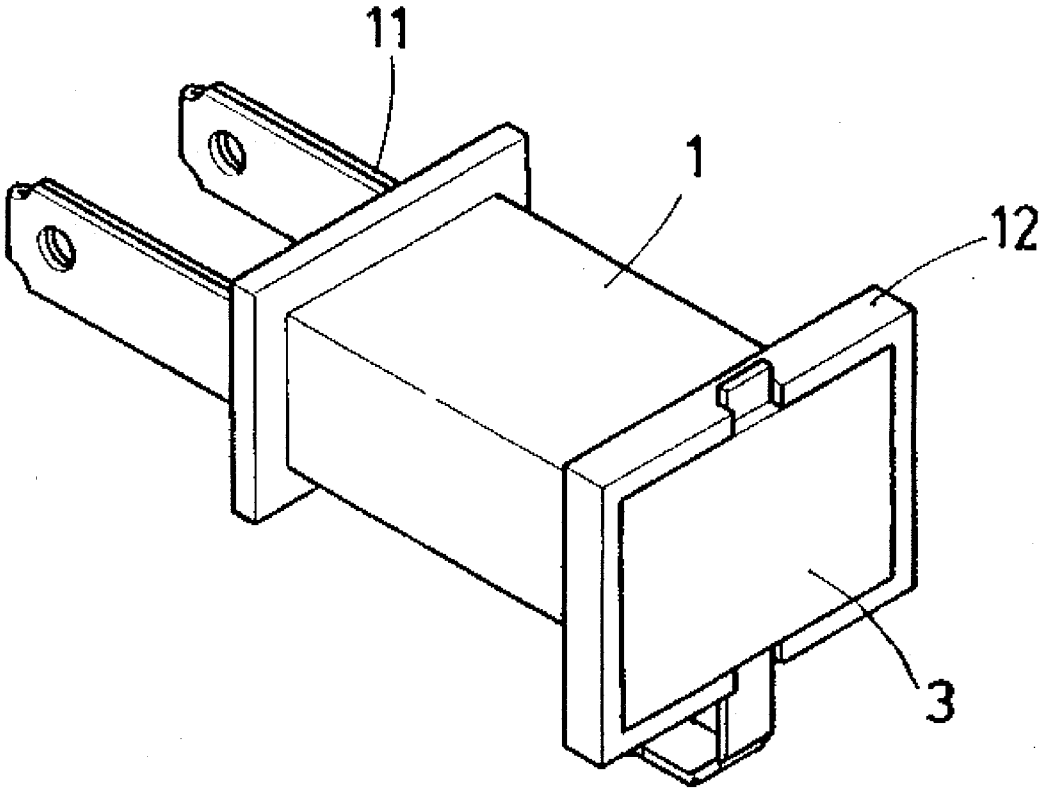
FIG. 4 is an isometric drawing of the invention herein with the socket cover plate in place.

As indicated in FIG. 2, FIG. 3 and FIG. 4, the front end of the AC mains power plug (1) of the invention herein is identical to those of a conventional AC mains power plug and, furthermore, is mainly comprised of a recessed section (13) at the rear end (12) that is of the same dimensions as the front end such that when the second AC mains power plug (2) is inserted, after the prongs (11) at the front end of the second AC mains power plug (2) are inserted into the socket holes (14) of the first AC mains power plug (1), the front end of the second AC mains power plug (2) is fully emplaced into the recessed section (13) and effectively results in a an extremely firm connection that will not dislodge due to the application of an external force. When not being utilized, a cover plate (3) seals the recessed section (13), a feature that increases safety and prevents the entry of objects and dust to circumvent accidents.

Figure 5:
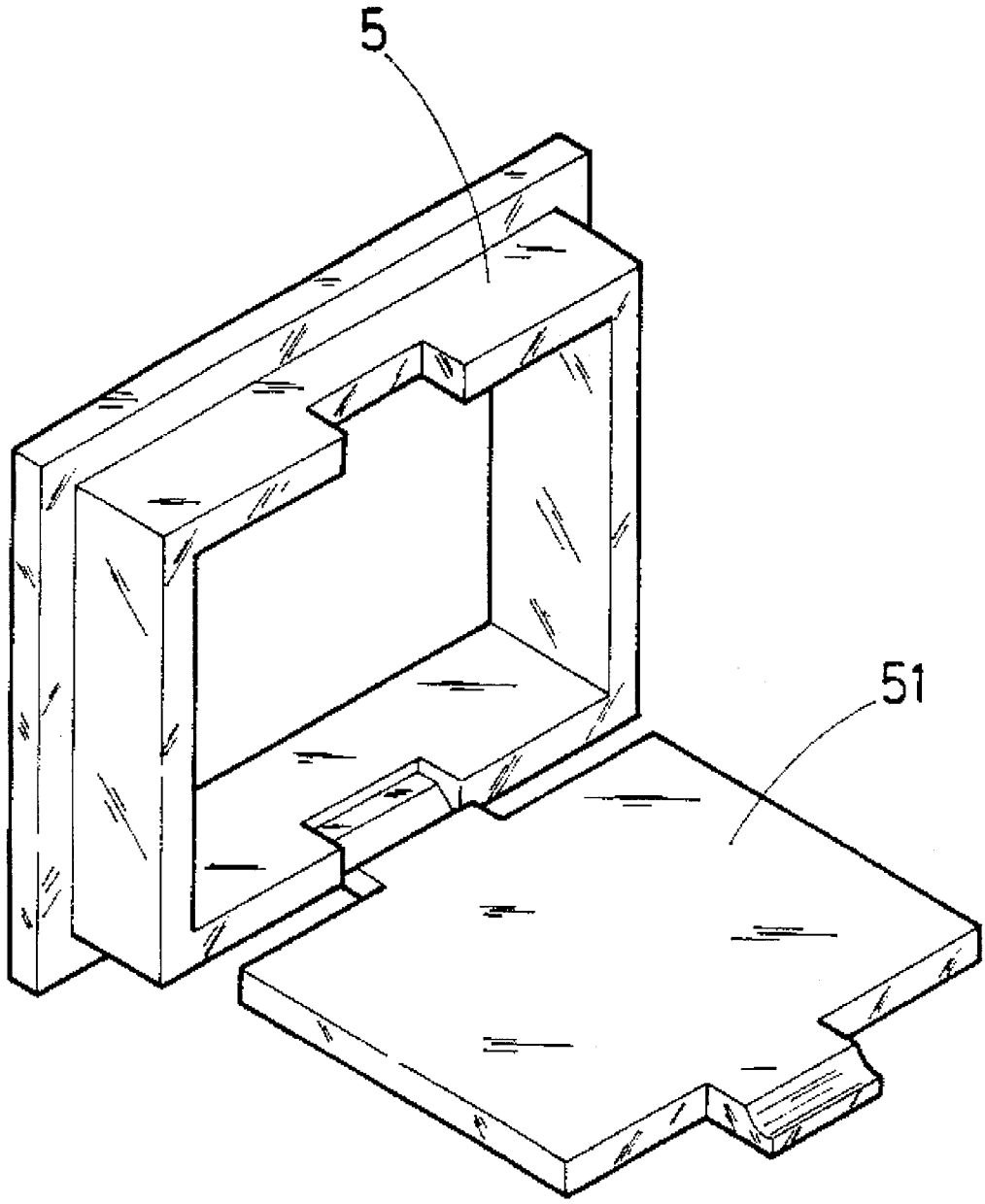
FIG. 5 is an isometric drawing of the invention herein as installed on a conventional AC mains power socket.
Figure 6:
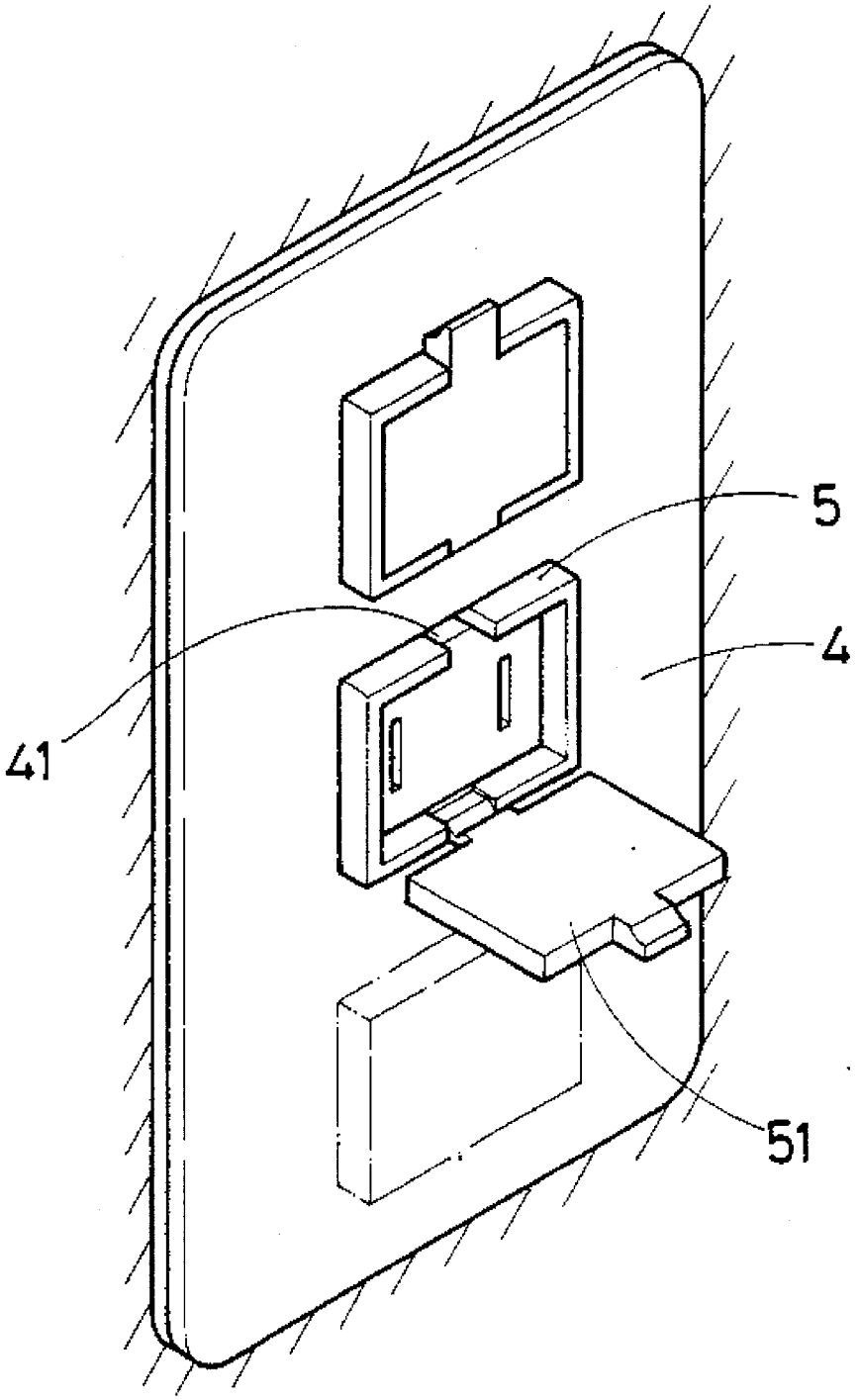
FIG. 6 is an is an isometric drawing of the invention herein showing a structural perspective of FIG. 5.
Figure 7:
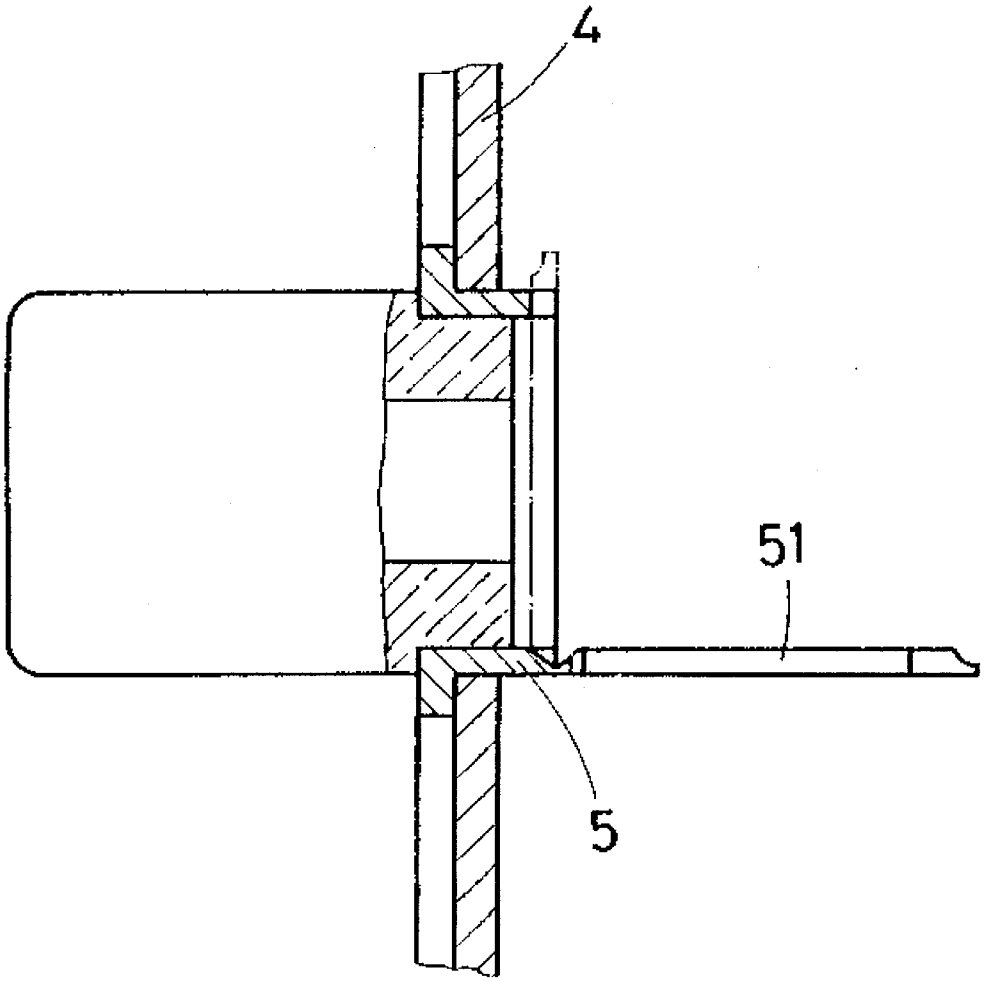
FIG. 7 is a cross-sectional drawing of FIG. 5.

As indicated in FIG. 5, FIG. 6 and FIG. 7, the same foregoing structure and principles are applied to a conventional wall-type AC mains power socket (4), wherein an insertion base (5) is installed around the socket holes (41) of the conventional wall-type AC mains power socket (4) such that the protruding edges of the insertion base (5) serves as an identical counterpart to the recessed section (13) of the invention herein; furthermore, a cover plate (51) is attached to the outer edge of the insertion base (5) to seal the prong holes when the wall-type AC mains power socket is not in utilization to effectively achieve a degree of safety.

In terms of the foregoing description, the recessed section (13) of the AC mains power socket of the invention herein provides for the firm insertion of an additional AC mains power plug in the structure that is obviously of original and practical value and, furthermore, the cover plate increases the effective safety of the invention herein; therefore, the invention herein complies with the requirements of a new invention for which the application for the granting of the respective patent rights is hereby submitted as lawfully stipulated in the prevailing patent regulations.

What is claimed is:

1. An electrical plug retention device for retaining the mated coupling of electrical plug and socket mechanisms having interfacing surfaces comprising:

(a) a rim member adapted to be coupled to said socket mechanism, said rim member having an inner wall portion for substantially bounding said interfacing surface of said socket mechanism, said inner wall portion being adapted to peripherally bound at least a substantial portion of said interfacing surface and project from said interfacing surface in a direction substantially normal thereto, said inner wall portion peripherally defining a recess for retaining said plug mechanism in said mated coupling;

(b) a cover plate removably coupled to said rim member for covering said recess defined by said inner wall portion, said cover plate having a substantially planar contour.

2. An electrical plug assembly for mated coupling with a plug mechanism having an interface surface characterized by a peripheral dimension comprising:

(a) socket means adapted to matingly couple with said plug mechanism, said socket means having a plug interface surface for substantially planar interface with said interface surface of said plug mechanism, said plug interface surface having a peripheral dimension substantially equivalent to said peripheral dimension of said plug mechanism, said socket mechanism having formed thereon a rim member having an inner wall portion peripherally bounding at least a substantial portion of said plug interface surface, said inner wall portion projecting from said plug interface surface in a direction substantially normal thereto; and, (b) a cover plate removably coupled to said socket means, said cover plate having a substantially planar contour and having a peripheral dimension substantially equivalent to said peripheral dimension of said plug interface surface.

3. An electrical plug retention device for an electrical socket mechanism having a plug interface surface supported within a wall surface to be substantially coplanar therewith comprising:

(a) a rim member adapted to be coupled to said socket mechanism, said rim member having inner and outer wall portions on opposing sides thereof, said inner wall portion being adapted to peripherally bound at least a substantial portion of said plug interface surface and project from said plug interface surface in a direction substantially normal thereto, said inner wall portion peripherally defining a recess for retaining a plug mechanism matingly coupled to said socket mechanism, said outer wall mechanism having a flange portion projecting outwardly therefrom to engage said wall surface for support of said plug retention device;

(b) a cover plate coupled to said rim member for covering said recess defined by said inner wall portion, said cover plate having a substantially planar contour.

* * * * *